US005667018A

United States Patent [19]

Hone et al.

[11] Patent Number: 5,667,018

[45] Date of Patent: Sep. 16, 1997

[54] FIRE CONTROL FOAM DISTRIBUTION SYSTEM FOR USE IN DISTRIBUTING FOAM BENEATH A PASSENGER BOARDING BRIDGE

[75] Inventors: George Dean Hone, Roy; Gary Ronald Mitchell, Salt Lake City, both of Utah

[73] Assignee: FMC Corporation, Chicago, Ill.

[21] Appl. No.: 582,058

[22] Filed: Jan. 2, 1996

[51] Int. Cl.[6] ..... A62C 3/00

[52] U.S. Cl. ..... 169/54; 169/15; 169/16; 169/17; 14/71.5

[58] Field of Search ..... 169/5, 14, 15, 169/16, 17, 18, 54; 14/71.5, 71.7

[56] References Cited

U.S. PATENT DOCUMENTS 4,543,677 10/1985 Haglund et al. ..... 14/71.5

*Primary Examiner*—Andrew C. Pike

*Attorney, Agent, or Firm*—Douglas W. Rudy; Michael B. K. Lee

[57] ABSTRACT

A fire control foam distribution system wherein foam is distributed to the area below a passenger boarding bridge includes a telescoping pipe system to get the foam to delivery manifolds at intermediate and at an outboard location of the passenger boarding bridge. Multiple foam delivery discharge nozzles are attached to the delivery manifolds to assist in directing the foam to the area below the passenger boarding bridge.

10 Claims, 4 Drawing Sheets

FIRE CONTROL FOAM DISTRIBUTION SYSTEM FOR USE IN DISTRIBUTING FOAM BENEATH A PASSENGER BOARDING BRIDGE

BACKGROUND OF THE INVENTION

1. Field of the Invention

This invention has to do with the distribution of a chemical foam fire suppression product used to deprive a fire of oxygen. The foam product distribution system is used in airport terminals to aircraft boarding bridge situations to deliver the foam to the area on the ground immediately below the passenger boarding bridge.

2. Description of the Prior Art

In state of the art installations at airports where passenger boarding bridges are used, large municipal airports, for instance, fire protection is commonly provided by means of stand-alone fire fighting equipment, sometimes including foam generating equipment, in the vicinity of the passenger boarding bridges. In addition it is usual for mobile foam delivery fire fighting apparatus to be readily available at airports to fight the category of rites experienced at airports and around aircraft and aviation fuels. Safety and fire control personnel at airports are well aware of the use of foam to fight fires at airports.

A standard for the protection of passenger boarding bridges is published by the National Fire Protection Association. This standard is Referred to as NFPA 417. In this standard there is a section, Section 4-1.3, relating to "Fixed Foam Systems." It states, in part, in the 1990 edition of the standard, "When a fixed foam system is installed, the protection shall be adequate to blanket the area under the walkway [passenger boarding bridge] when positioned at the aircraft exit doors and for a distance of approximately 10 ft (3 m) in all directions." The standard continues but nowhere in the standard is there a teaching of how the fixed foam system standard can be implemented. In other words there is nothing in the standard that teaches the invention presented herein.

The prior art teaches automatic actuation of foam distributing equipment and is, for instance, mentioned in the standard referred to above.

In the early 1980's one of the two inventors of the foam delivery system disclosed herein had the idea, along with another person who worked for a chemical company that supplied foaming agents to industry, of having a foam dispensing nozzle attached to the inner end of a passenger boarding bridge. It was thought at that time that the use of a foaming agent, delivered from a fire extinguishing system beneath a passenger boarding bridge with a delivery nozzle that rotated with the bridge at the rotunda end of the bridge, was not patentable because foam for fire control was well known at airports.

One difficulty experienced with foam delivery systems under passenger boarding bridges was that the bridge sections telescoped within each other preventing the mounting of fixed foam distribution nozzles to the bridge sections.

The invention presented here represents an improvement to that early invention. One element of this invention is the provision of the telescoping foam delivery conduit that gets the foam from the inboard end of the passenger boarding bridge to the outboard end of the bridge. Another improvement is that the bridge presented here has a multiple nozzle foam discharge manifold mounted to the underside of the outermost bridge section. These and other advantages of the foam delivery system will be discussed in this specification.

SUMMARY OF THE INVENTION

The invention presented herein is a foam delivery system that is carried by an extendible passenger boarding bridge substructure. These passenger boarding bridges or walkways are in common use today at major airports around the world. The delivery system delivering the foam is positioned to deliver foam under the bridge regardless of the extended or retracted position of the bridge. A series of telescoping tubes are employed to allow extension and retraction of the delivery system to extend or retract with the extension or retraction of the passenger boarding bridge.

The passenger boarding bridge contemplated for adoption of the foam delivery system hereof is a multiple section bridge having at least two sections. The bulk of the foam delivery nozzles are attached to a manifold carried on the bottom side of the outboard or outermost bridge section of the multiple section passenger boarding bridge.

BRIEF DESCRIPTION OF THE DRAWINGS

The appended drawings, when perused in conjunction with this specification, will enable the reader to fully appreciate the invention herein. In the drawing figures.

DESCRIPTION OF THE PREFERRED EMBODIMENT

Figure 1:
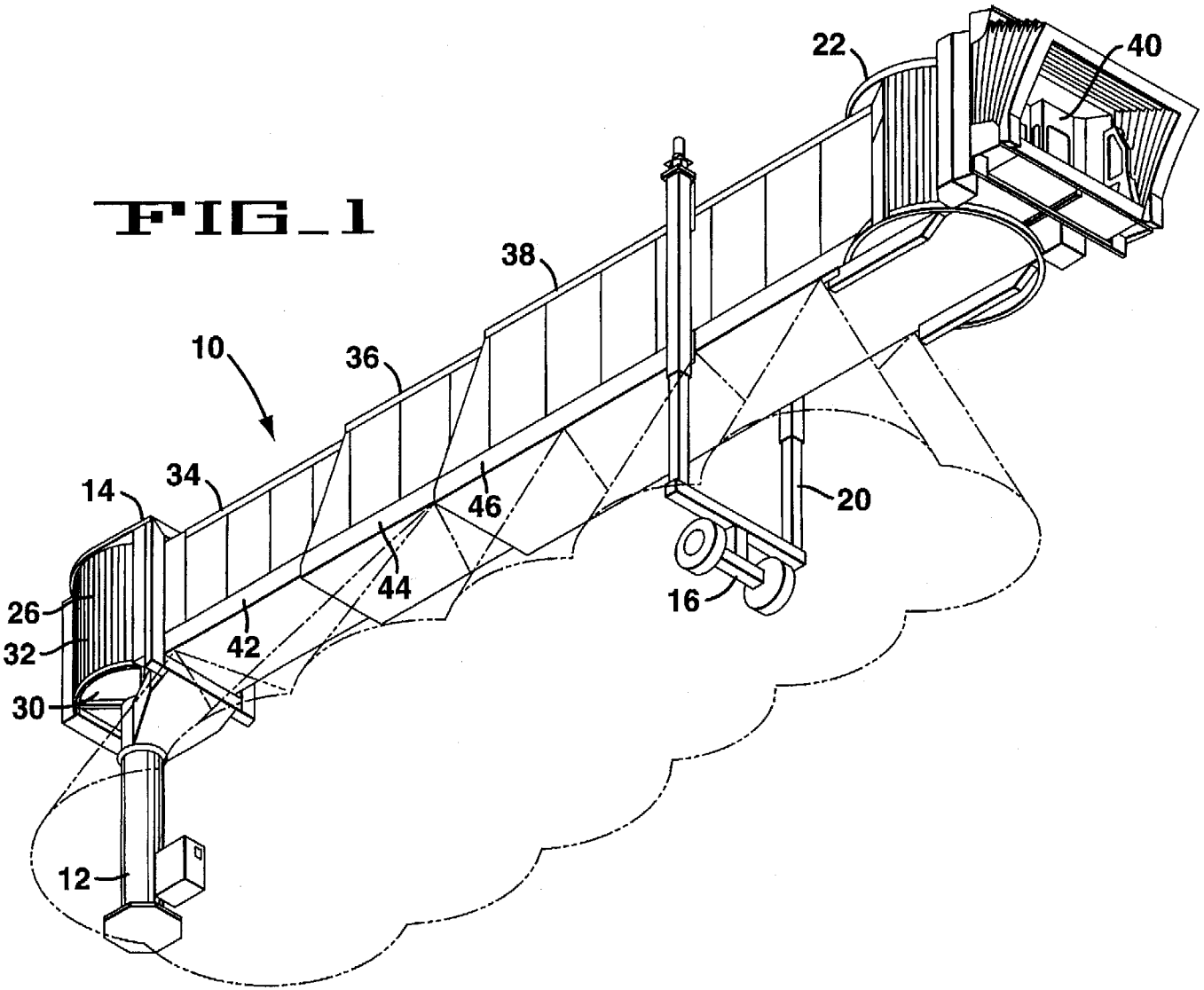
FIG. 1 is a projected view of a passenger boarding bridge, with detail components removed for clarity, as viewed from the bottom of the bridge.

Looking first at FIG. 1, a reasonable representation of the structure of a passenger boarding bridge can be seen. The passenger boarding bridge, generally 10, is supported on a pedestal 12 at an inboard end 14 thereof. The inboard end 14 is the bridge access to a waiting aircraft from the passenger terminal. As is well known, the pedestal pivotally supports the inboard end of the bridge while a pair of wheels 16 and an elevatable structure 20 supports the outboard end of the passenger boarding bridge. The wheels 16 are used to locate the outboard end 22 of the bridge relative to the aircraft that is being unloaded or loaded with passengers.

Supported on the pedestal 12 is the rotunda 26 of the bridge. It is provided with a generally fire resistant floor 30 and wall 32 structure. Attached to the rotunda is the bridge portion of the passenger boarding bridge generally 10. It is comprised of multiple sections 34, 36, and 38 that are telescopically nested to enable the bridge portions to extend and retract relative to the rotunda 26 of the structure. In the embodiment shown there are three sections of bridge structure; two of these, 34 and 36, will telescope into the outermost section 38 as is well known in the art of passenger boarding bridge construction. More properly, in the preferred embodiment shown in the figures, the two outer sections 36 and 38, will telescope toward the innermost section 34. The innermost section 34 is pivotally attached to the rotunda section 32 so that the innermost section can pivot up or down relative to the horizon.

The outboard end 22 of the passenger boarding bridge 10 includes a vestibule section 40 pivotally attached to the outermost bridge structure 38. This vestibule 40 is the section of the bridge that is positioned adjacent the aircraft body (not shown) in preparation of loading and unloading passengers from the aircraft.

The telescoping sections 34, 36, and 38 of the bridge each have a floor support structure that includes significant frame rail means 42, 44, and 46. These frame rails support the floor of the bridge and the remaining superstructure of it. In addition they also provide the mounting location for the foam dispersion invention presented herein. The frame rails of the bridge can best be seen in FIG. 2.

Figure 2:
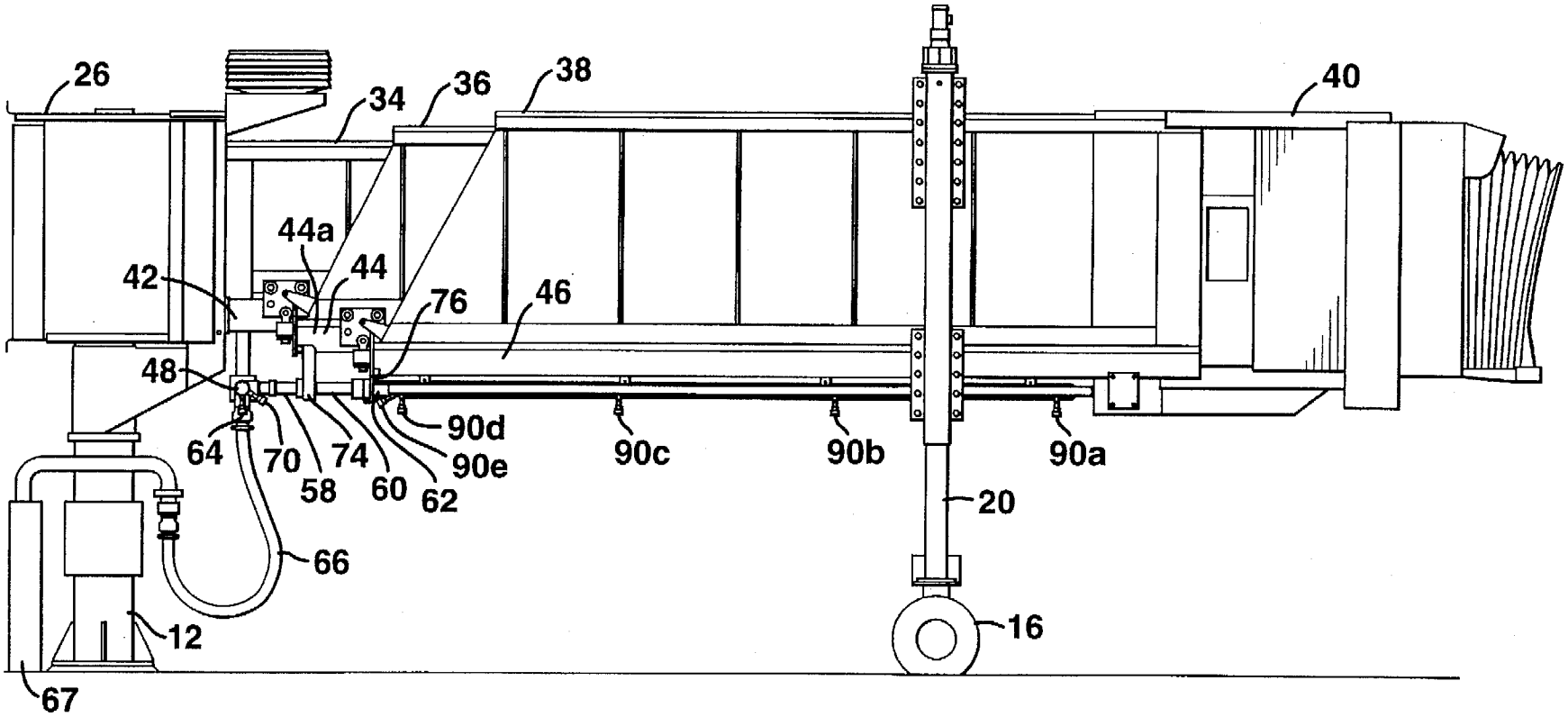
FIG. 2 is a side elevation view of the passenger boarding bridge of FIG. 1.
Figure 6:
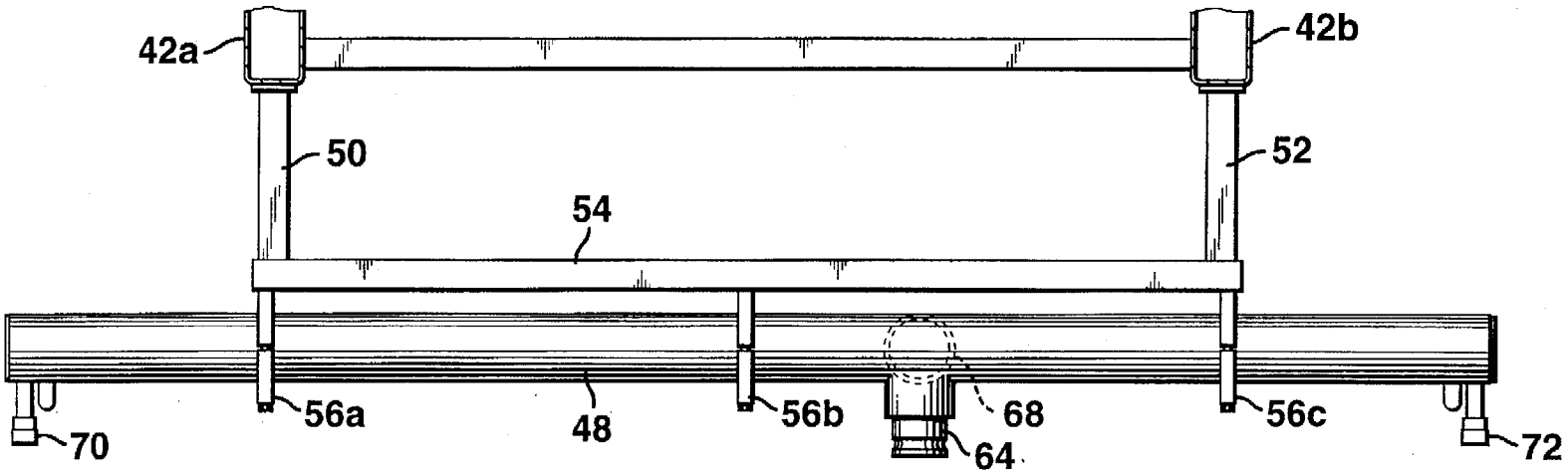
FIG. 6 is a secondary manifold wherein foam is supplied to the main delivery manifold.
Figure 7:
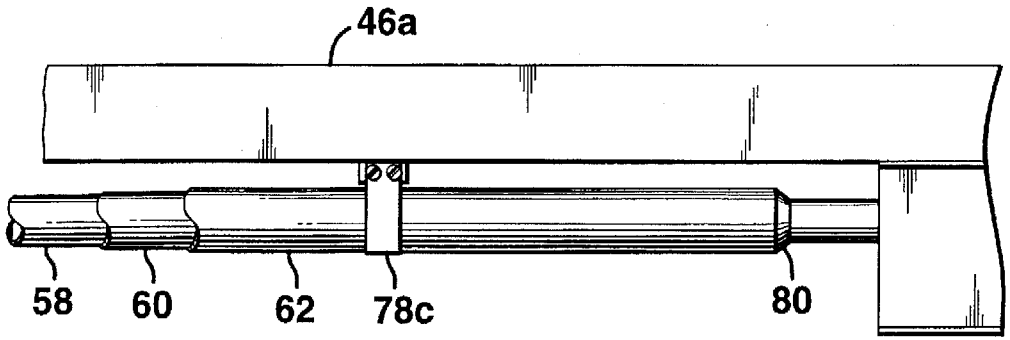
FIG. 7 is the foam delivery manifold showing the telescopic pipe portion of the invention.

In FIG. 2 the frame rails are items 42, 44, and 46. Starting with frame rail section 42 of the inboard or innermost bridge section, and looking at FIG. 6 as well as FIG. 2, there is a secondary manifold 48 hanging from a pair of descending brackets 50 and 52 attached to frame rails 42*a* and 42*b*. A spreader 54 provides a mounting location for hangers 56*a*, 56*b*, and 56*c* which support the secondary manifold 48. The pair of descending brackets 50 and 52 allow positioning of the secondary manifold 48 at an elevation aligned with the set of telescoping foam delivery pipes or tubes 58, 60, and 62.

Ingress of foam to the manifold is through fitting 64 to which the foam supply flexible feed or hose 66 is attached (see FIG. 2). The hose 66 is connected to a conventional form generator schematically represented by box 67 in FIG. 2.

The bulk, unregulated foam discharge port 68 will serve foam through tube 58 to the outboard elements of the foam delivery system. A number of foam delivery nozzles, such as 70 and 72, are attached to and receive foam for controlled and directed delivery from the secondary manifold 48.

Returning primarily to FIG. 2 the support bracket 74 for the intermediate section 60 of foam delivery pipe can be seen. The innermost section 58 of foam delivery pipe is carried inside the intermediate section 60 of foam delivery pipe and is thus indirectly supported by support bracket 74. Support bracket 74 is carried by intermediate bridge section frame rails, the nearside rail 44*a* shown in FIG. 2 and the farside rail hidden and not shown in this figure, by means of a spreader (not shown).

Figure 3:
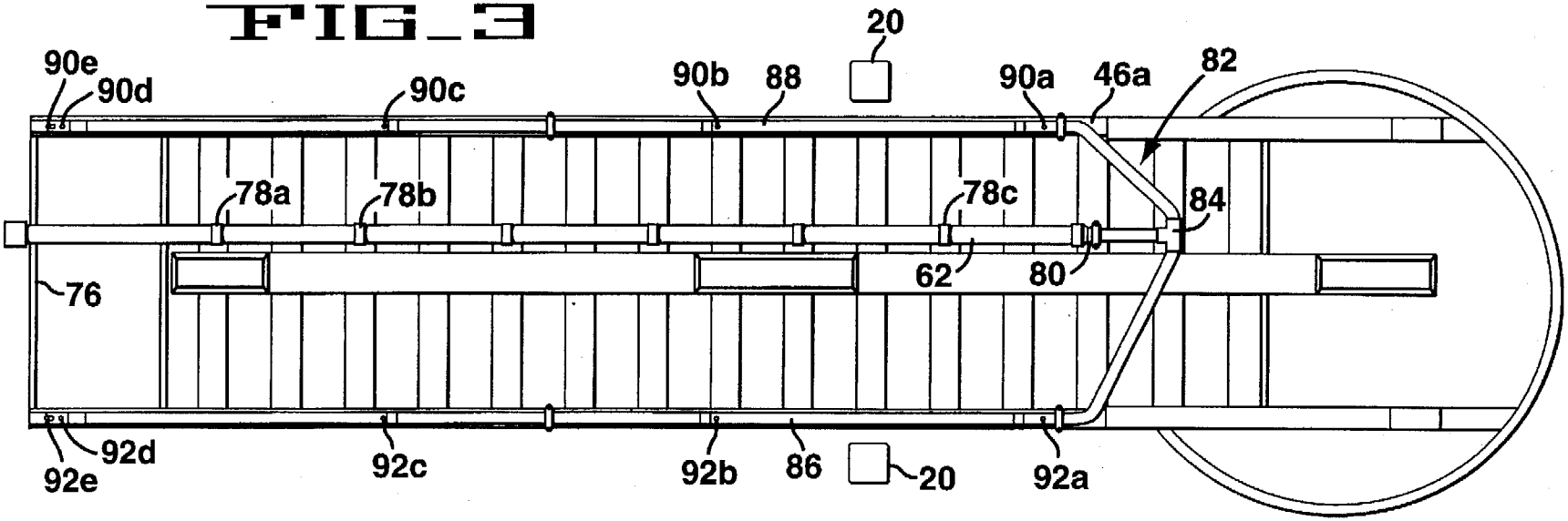
FIG. 3 is the bottom view of a portion of the passenger boarding bridge of FIGS. 1 and 2.
Figure 5:
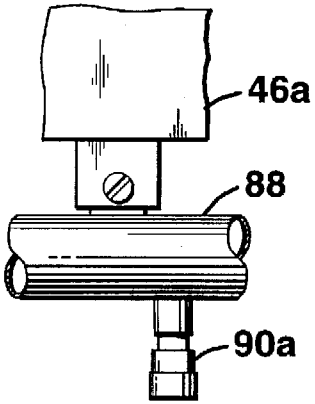
FIG. 5 is a portion of a passenger boarding bridge, a support hanger, a portion of a foam delivery manifold, and a foam delivery nozzle.
Figure 4:
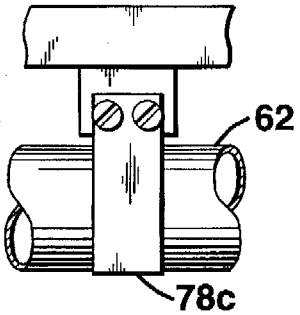
FIG. 4 is a portion of a passenger boarding bridge, a support hanger, and a portion of a foam delivery manifold.

The outermost or outboard bridge section 38 supports foam delivery pipe 62 by means of support bracket 76 at the inboard end as well as hangers such as 78*a*, 78*b*, and 78*c* attached to descending mounting straps or means from the bottom of the outboard bridge section such as the bottom side 46*a* of frame rail 46. The outboard end 80 of the foam delivery pipe is connected to a foam delivery manifold generally 82 best seen in FIG. 3.

The foam delivery manifold 82 is tied at 84 into two branches 86 and 88. These foam delivery branches extend from the outboard end of the outermost bridge section back toward the terminal in the embodiment shown. A series of foam delivery nozzles such as 90*a*, 90*b*, 90*c*, 90*d*, and 90*e* and 92*a–e* are carried by and access the branches 88 and 86 respectively. These nozzles may be adjustably positioned as for instance 90*e* is or they may emanate downwardly to deliver foam in a cone to get maximum foam deployment.

In operation the telescoping pipes 58, 60, and 62 will telescope relative each other as the bridge sections are moved outboard away from the terminal and inwardly toward the terminal. In the preferred embodiment these telescoping tubes, also known as telescopic foam delivery pipes, will be a close fit within each other and would include a wiper seal and possible a wear band (not shown) although no special sealing arrangement is believed to be necessary. Of course other types of seals between the telescoping pipe sections, even a gel seal, could be used if desired.

Foam will be delivered by a conventional foam generator through flexible tube 66 to the secondary manifold 48. Some of the foam will be delivered through the nozzles such as 70 and a good percentage of the foam will enter pipe 58, travel through it and pipe 60 and into pipe 62. The foam will enter the manifold 82 and eventually be delivered to the zone beneath the bridge by nozzles such as 90 and 92(*a–e*). These nozzles, such as 90 and 92(*a–e*) may be directed downwardly and nonperpendicularly as is shown in FIG. 2.

It is expected that foam generation and delivery will be automatically triggered by means of heat and or smoke detectors in the vicinity of the passenger boarding bridge. This triggering of the foam delivery system will be responsive to conventional triggering devices not part of this invention. A manual override system is also expected to be incorporated in the triggering scheme.

In summary the invention herein in its simplest embodiment is a system for the delivery of fire suppression foam to the area beneath a passenger boarding bridge which includes a fire suppression foam generating means which will, by flexible connection and delivery conduit attached to the fire suppression foam generating means, and telescopic foam transporting means connected to said flexible connection and delivery conduit means, deliver foam to the area below the passenger boarding bridge. A telescopic foam transporting means is carried by the passenger boarding bridge, and connected to a foam delivery manifold means which communicates and is connected to the telescopic foam transporting means. As explained above, the foam delivery manifold means carried by the passenger boarding bridge provides the attachment point for foam delivery discharge nozzles for the delivery of foam to the area beneath the passenger boarding bridge.

What is claimed is:

1. A system for delivery of fire suppression foam to an area beneath a passenger boarding bridge, said passenger boarding bridge having an inboard end, said system comprising:

fire suppression foam generator, flexible connection and delivery conduit attached to said fire suppression foam generator, telescopic foam delivery pipe having an inboard end and an outboard end connected to said flexible connection and delivery conduit, said telescopic foam delivery pipe being carried by said passenger boarding bridge, foam delivery manifold communicating and connected to said telescopic foam delivery pipe and said foam delivery manifold being carried by said passenger boarding bridge, and foam delivery discharge nozzles attached to said foam delivery manifold for the delivery of the foam to the area beneath said passenger boarding bridge.

2. The invention in accordance with claim 1 wherein said passenger boarding bridge includes at least two bridge sections, one of said sections being telescopically adjustable relative to another of said sections, one of said sections being an outermost section, said telescopic foam delivery pipe being carried by said outermost section of said bridge sections.

3. The invention in accordance with claim 2 further comprising a secondary manifold carried on a portion of said passenger boarding bridge other than said outermost section of said passenger boarding bridge.

4. The invention in accordance with claim 3 wherein said foam delivery manifold comprises a pair of manifold elements extending from said outboard end of said telescopic foam delivery pipe toward said inboard end of said passenger boarding bridge.

5. The invention in accordance with claim 4 wherein said outermost section of said bridge sections has an inboard end and said manifold elements extend inboard to said inboard end of said outermost section of said bridge sections.

6. The invention in accordance with claim 5 wherein said manifold elements are spaced apart from each other and are located proximate sides of said outermost section of said passenger boarding bridge.

7. The invention in accordance with claim 6 wherein said foam delivery discharge nozzles are directed downwardly from said manifold elements.

8. The invention in accordance with claim 7 wherein at least one of said foam delivery discharge nozzles is directed downwardly and nonperpendicularly to said manifold members.

9. The invention in accordance with claim 8 wherein said secondary manifold includes a plurality of foam delivery discharge nozzles attached thereto.

10. The invention in accordance with claim 8 wherein said telescopic foam delivery pipe includes at least two pipe elements with one of said pipe elements telescopically nested inside a second of said pipe elements such that said pipe elements of said telescopic foam delivery pipe telescope within each other as said bridge sections respectively telescope between each other.

* * * * *